US007167100B2

(12) United States Patent
Yeh

(10) Patent No.: US 7,167,100 B2
(45) Date of Patent: Jan. 23, 2007

(54) APPARATUS FOR LEAVING MESSAGE ON REFRIGERATOR

(76) Inventor: Ming-Hsiang Yeh, 14F, No. 375, Nan-Gang District, Fu De Street, Taipei City (TW)

( * ) Notice: Subject to any disclaimer, the term of this patent is extended or adjusted under 35 U.S.C. 154(b) by 171 days.

(21) Appl. No.: 10/938,525

(22) Filed: Sep. 13, 2004

(65) Prior Publication Data

US 2006/0055553 A1 Mar. 16, 2006

(51) Int. Cl.
*G08B 25/08* (2006.01)

(52) U.S. Cl. ..... 340/692; 340/533; 340/539.1; 340/545.6; 434/308

(58) Field of Classification Search ..... 340/585, 340/540, 539.14, 545.6, 692, 815.4, 384.3, 340/384.7, 539.1, 533; 434/308
See application file for complete search history.

(56) References Cited

U.S. PATENT DOCUMENTS 4,075,615 A * 2/1978 Garcia ..... 340/585
4,691,195 A * 9/1987 Sigelman et al. ..... 340/545.6
4,835,520 A * 5/1989 Aiello ..... 340/545.6
5,387,108 A * 2/1995 Crowell ..... 434/319
5,479,152 A * 12/1995 Walker et al. ..... 340/545.6
5,894,275 A * 4/1999 Swingle ..... 340/692
6,502,411 B2 * 1/2003 Okamoto ..... 62/129
6,690,912 B1 * 2/2004 Vaughn ..... 434/308
6,882,280 B2 * 4/2005 Ferragut, II ..... 340/692
6,961,003 B2 * 11/2005 Lin ..... 340/692
6,982,640 B2 * 1/2006 Lindsay et al. ..... 340/540
2003/0156688 A1 * 8/2003 McCarty et al. ..... 379/67.1
2004/0078203 A1 * 4/2004 Peter ..... 704/275

* cited by examiner

*Primary Examiner*—Thomas Mullen
(74) *Attorney, Agent, or Firm*—Troxell Law Office, PLLC

(57) ABSTRACT

An apparatus for leaving a message on a refrigerator is disclosed. The apparatus can be mounted on the refrigerator so as to broadcast a voice upon opening a door of the refrigerator. A control unit for processing and controlling the voice is mounted on the main body of the present invention, wherein the control unit is a signal processing control center. A sensor is mounted on the inner side of the door of the refrigerator and is connected to the control unit of the main body. When the door of the refrigerator is open, the sensor is triggered to transmit a sensor signal to the control unit to broadcast the voice. A timer is also connected to the control unit to active the apparatus at a predetermined time. In other words, a predetermined voice content is broadcasted. Thus, the reminding, warning, and encouraging effects are accomplished so as to act an interactive communication medium for family members.

9 Claims, 3 Drawing Sheets

APPARATUS FOR LEAVING MESSAGE ON REFRIGERATOR

BACKGROUND OF THE INVENTION

The present invention relates to an apparatus for leaving a message on a refrigerator, and more particularly to an apparatus through which the message can be pre-recorded and taken, and the voice can be broadcasted upon opening a door of the refrigerator.

Refrigerator is an important machine of a house. During one day, everybody has many chances to open the door of the refrigerator, more particularly in the summer. Since there are a lot of foods stored in the refrigerator, many people, more particularly the children, eat excess foods. Accordingly, it is necessary to warn and remind these people, when they open the door of the refrigerator. Besides, if the reminding can be provided when the refrigerator door is open, the foods such as vegetables stored in the refrigerator can be prevented from expiring.

Even through family members met with one other everyday, a family member usually cannot find somebody, when he wants to leave words to this person, or when he wants to say something that he cannot talk about face to face. Another communication way at this moment is to leave a message. A common method is to set up a message board. Thus, the content of the message can be written down on the message board or the notepaper that is thereafter pasted up on the message board. Since the refrigerator is in common use, it can be used to leave a message by sticking the message on it. The current method of leaving message is passive in that it utilizes written text. Thus, its interactive effects on reminding, warning, or encouraging somebody are poor. With the progress of the digital image and voice, if the planar type of text message can be replaced with the dynamic type of audio-visual message and used to guide the family member to take the message, a better, more interactive communication medium will result.

SUMMARY OF THE INVENTION

The main purpose of the present invention is to provide an apparatus for leaving a message on a refrigerator, in which a sensor is mounted on an inner side of a door of the refrigerator for actuating the pre-recorded voice when the sensor is triggered by opening the door so as to achieve the warning effect.

Another purpose of the present invention is to provide an apparatus for leaving a message on a refrigerator, wherein the timer can be set to broadcast a predetermined voice content at a predetermined time. In other words, various content regarding reminding or surprise can be provided to enable interactive communication.

It is still another purpose of the present invention to provide an apparatus for leaving a message on a refrigerator for notifying a predetermined person to take the message through a plurality of record/play buttons and corresponding indicator lights.

According to the aforementioned purposes of the present invention, a sensor is connected to a main body of the present invention through a connection line and mounted on an inner side of a door of the refrigerator. A control unit acts as a processing control center of the voice and is mounted on the main body for processing and controlling the recording and broadcasting of voice. The present invention further comprises:

a voice input device connected to the control unit to input a voice signal for recording the voice, wherein the voice input device is a microphone;

a storage device for storing voice and music data connected to the control unit through a transmission interface;

a broadcasting device for broadcasting the recorded voice or music connected to the control unit, wherein a speaker is driven by an audio amplifier to broadcast the voice or music;

a timer for broadcasting a predetermined voice content at a predetermined time connected to the control unit;

a plurality of record/play buttons for recording voice or taking the message, wherein several indicator lights are mounted corresponding to these record/display buttons for notifying somebody that there is a message for him.

The sensor is mounted on the inner side of the door of the refrigerator and is connected to the control unit of the main body. When the door of the refrigerator is open, the sensor is triggered to transmit a sensor signal to the control unit to broadcast the recorded voice for accomplishing reminding, warning, and encouraging effects. The sensor is an optical switch or a micro switch.

The aforementioned aspects and advantages of the present invention will be readily clarified in the hereafter description of examples of preferred embodiments of the present invention, in reference with the enclosed drawings.

The present invention intends to cover all alternatives and arrangements of these alternatives. Nevertheless, the selected preferred embodiment is described in the specification and illustrated in the accompanying drawings.

DETAILED DESCRIPTION OF THE PREFERRED EMBODIMENT

Figure 1:
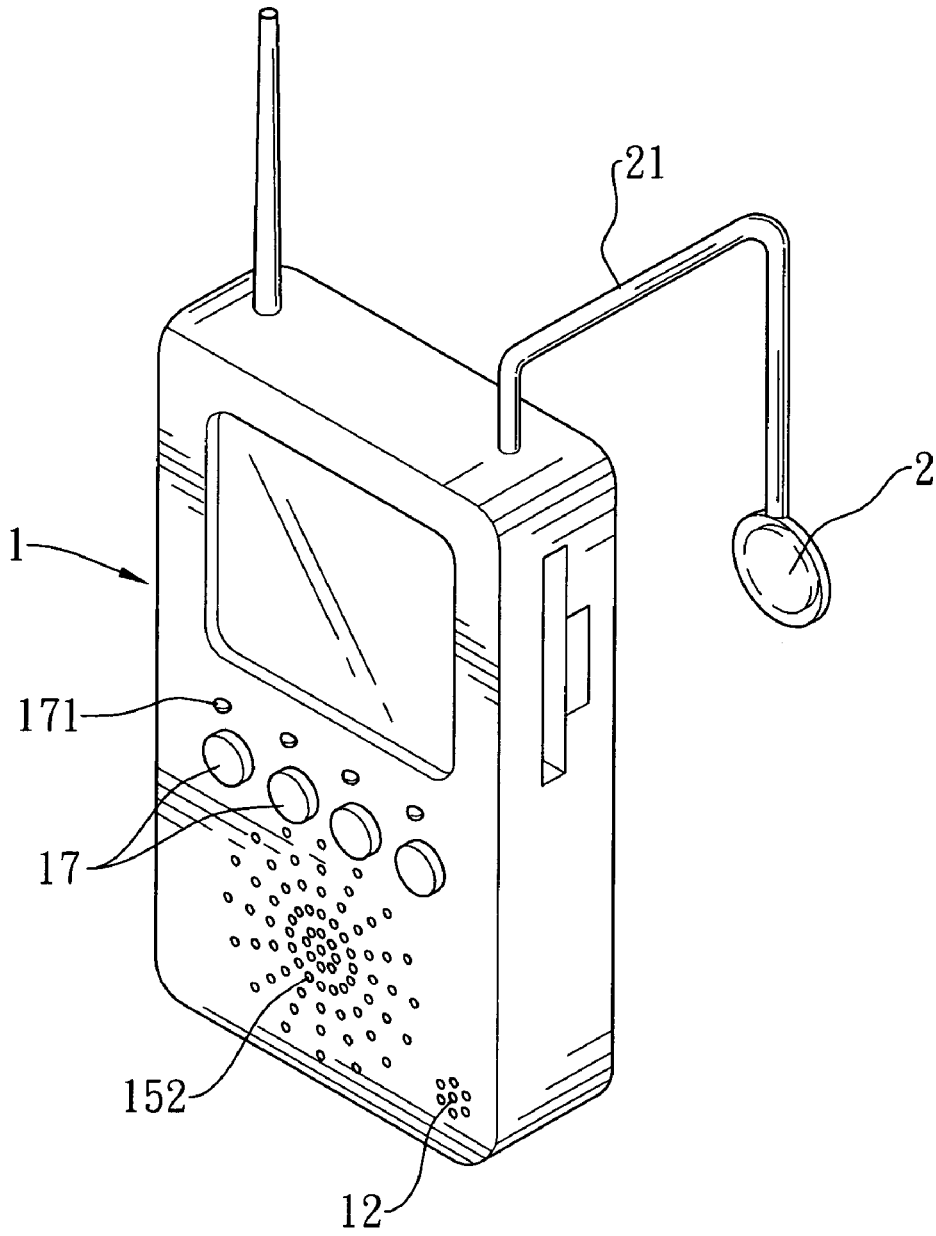
FIG. 1 is a schematic diagram broadcasting an outward-appearance of the present invention.
Figure 2:
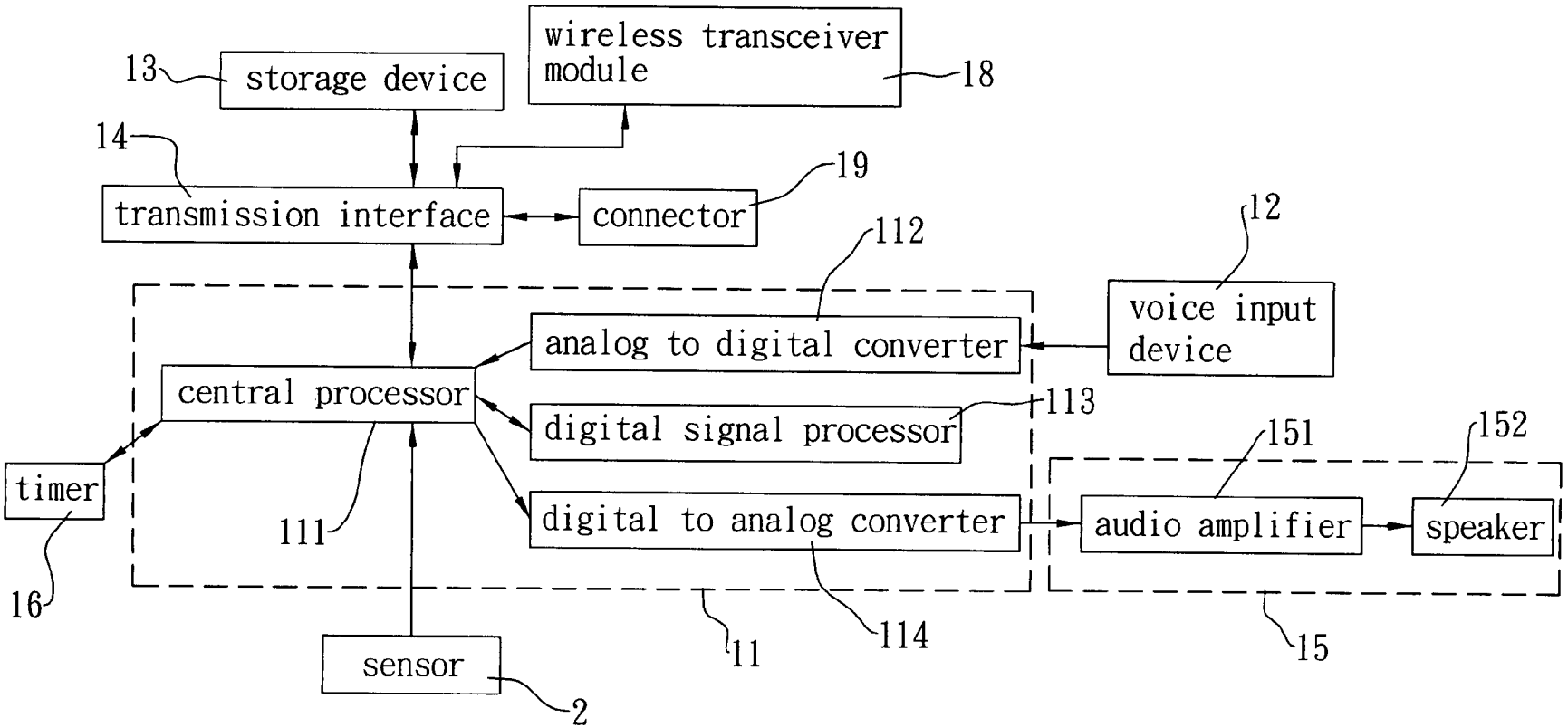
FIG. 2 is a composition block diagram of the present invention.

FIG. 1 is a schematic diagram showing an outward-appearance of the present invention. FIG. 2 is a composition block diagram of the present invention. As shown in FIG. 1 and FIG. 2, a main body 1 comprising the following devices is provided in the present invention.

A control unit 11 acts as a processing control center of a signal and is used for processing and controlling the recording and playing of a voice signal, wherein the control unit 11 comprises a central processor 111 acting as a processing control center of the signal, an analog to digital converter 112 for converting the inputted voice into a digital signal and transmitting the digital signal to the central processor 111, a digital signal processor 113 for performing a digitizing treatment of the voice signal connected to the central processor 111, and a digital to analog converter 114 for converting an outputted signal into an analog signal.

A voice input device 12 such as a microphone for inputting sound, such as to record the voice signal to record the voice is connected to the control unit 11.

A storage device 13, for example, a flash memory card or a hard disk, for storing recorded sounds such as voice and music data, is connected to the control unit 11 through a transmission interface 14.

A broadcasting device 15 for broadcasting the recorded voice or music is connected to the control unit 11, wherein a speaker 152 for broadcasting sound is driven by an audio amplifier 151.

A timer 16 for broadcasting a predetermined voice content at a predetermined time is connected to the control unit 11.

Several record/play buttons 17 for recording various voice messages or taking the messages, wherein several indicator lights 171 are mounted corresponding to these record/play buttons 17 for notifying somebody that there is a message for him.

These record/play buttons 17 can be assigned to various persons, for example, a first button is assigned to father, a second button is assigned to mother, a third button is assigned to their child, and so forth. When a family member wants to leave a message to the mother, the second button can be pressed down so as to input voice through the microphone to record a voice message. Accordingly, a corresponding indicator light 171 will be lighted to notify the mother that there is a message for her. When the mother sees the second indicator light is lighted, she can press down the second record/play button to take the message for her. Consequently, a predetermined person can be notified to take the message.

A wireless transceiver module 18 is connected to the control unit 11 for interacting with or sending data to a computer or other compliant apparatus. The wireless transceiver module 18 is a Bluetooth module, a wireless frequency modulation system, an infrared ray transmission, a Radio Frequency Identification Code (RFID) system, etc. The RFID system can be applied to record and manage foods that are stored in the refrigerator via a reading device so as to duly access and utilize these data via the computer or other compliant device for organizing these foods. For example, rotten vegetables, articles that are in short supply, or articles that are expired can be communicated to predetermined persons by warning messages or sending out news flashes. In addition, suggestions that regard nutrition of the whole family, for example, too few calories, too much fat absorption, exercise more, eat more vegetables, and so forth, can be provided by programming or data operation. The RFID system can identify the identities of users so as to execute some instructions or to manage and control incoming and outgoing of family members.

A connector 19, such as a USB interface card, for transmitting data is connected to an apparatus, such as computer.

A sensor 2 is mounted on the inner side of the door of the refrigerator and is connected to the control unit 11 of the main body 1 through a connection line 21. When the door of the refrigerator is open, the sensor is triggered to transmit a sensor signal to the control unit 11 to broadcast the voice. The sensor 2 is an optical switch or a micro switch.

Figure 3:
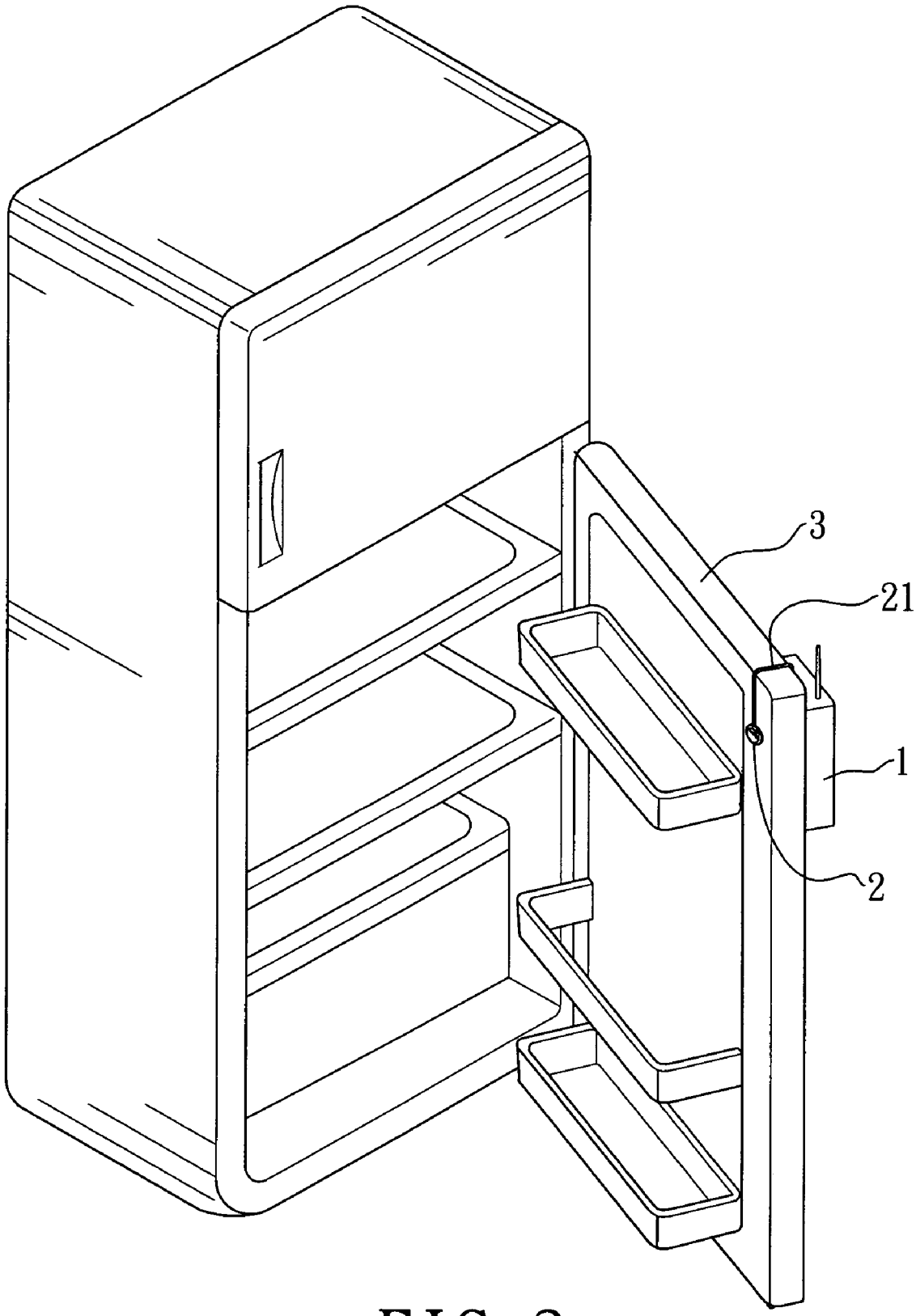
FIG. 3 is a schematic diagram the present invention mounted on the refrigerator.

Whereas the aforementioned description, as shown in FIG. 3, the present invention can be fixed on the door 3 of the refrigerator and fixed on the inner side of the door 3 of the refrigerator through the connection line 21. The sensor 2 is a micro switch that is pressed by the door 3 of the refrigerator. When the door 3 is open, the micro switch will enable the broadcasting of the voice. The broadcasting of the voice can be coupled with a time setting of the timer 16 for automatically broadcasting a predetermined content at a predetermined time. For example, when the refrigerator door is opened at midnight, then "be careful of eating too much fat" or "you are too fat" is broadcasted to warn the person who wants to reduce weight. When the refrigerator door is opened at noon, then "only one popsicle is allowed" is broadcasted to warn the child who gets out of class and comes home earlier. The sensor 2 can also be an optical switch, so that when the door 3 of the refrigerator is open, the light will trigger the switch to transmit an enabling signal to the control unit 11 to actuate the broadcasting device 15 to broadcast the voice.

Consequently, according to the configuration of the present invention, the member of the family is able to pre-record the matter that he wants to account for, the words that he cannot say face to face, or the surprise that he wants to give on a special date, such as birthday. In all of these circumstances, the present invention can be applied to achieve the purposes of reminding, warning, and encouraging one another. Thus, the present invention is an excellent interactive communication medium.

Therefore, as is understood by a person skilled in the art, the present invention achieves the aforementioned purpose according to the above description and satisfies the requirements of patent law. The application for a patent is therefore submitted.

As is understood by a person skilled in the art, the foregoing preferred embodiments of the present invention are examples of the present invention rather than limiting of the present invention. It is intended that various modifications and similar arrangements be included within the spirit and scope of the appended claims, the scope of which should be accorded the broadest interpretation so as to encompass all such modifications and similar structure.

The invention claimed is:

1. An apparatus for leaving a message on a refrigerator comprising:

a control unit for processing and controlling the recording and broadcasting of a voice;

a voice input device for inputting a voice signal to record the voice connected to the control unit;

a storage device for storing data of the recorded voice and of music connected to the control unit;

a broadcasting device for broadcasting the recorded voice or music connected to the control unit; and a sensor connected to the control unit so as to transmit a sensor signal to the control unit and to actuate the broadcasting device to broadcast the recorded voice, wherein the sensor is connected to a main body of the apparatus through a connection line and mounted on an inner side of a door of the refrigerator so as to transmit the sensor signal indicating that the door is open to the control unit.

2. The apparatus for leaving a message on a refrigerator of claim 1, wherein the sensor is a micro switch.

3. The apparatus for leaving a message on a refrigerator of claim 1, wherein the sensor is an optical switch.

4. The apparatus for leaving a message on a refrigerator of claim 1, wherein a timer is connected to the control unit to broadcast a predetermined voice at a predetermined time.

5. The apparatus for leaving a message on a refrigerator of claim 1, wherein a plurality of record/play buttons are connected to the control unit for recording the voice or playing back the recorded voice or music.

6. The apparatus for leaving a message on a refrigerator of claim 1, wherein a plurality of indicator lights are mounted corresponding to a plurality of record/play buttons to notify a predetermined person to play back the recorded voice or music.

7. The apparatus for leaving a message on a refrigerator of claim 1, wherein a wireless transceiver module is connected to the control unit for interacting with a computer or other compliant apparatus.

8. The apparatus for leaving a message on a refrigerator of claim 7, wherein the wireless transceiver module is a Radio Frequency Identification Code (RFID) system.

9. The apparatus for leaving a message on a refrigerator of claim 1, wherein the control unit connects to a connector to connect to a computer for data transmission.

* * * * *